US005347660A

United States Patent [19]

Zide et al.

[11] Patent Number: 5,347,660

[45] Date of Patent: Sep. 20, 1994

[54] ADJUSTABLE HIGH/LOW HOOK-UP CHIN STRAP FOR ATHLETIC HELMETS

[76] Inventors: Rodney M. Zide, 7 Painters Crossing, Williamstown, W. Va. 26187; James L. Rector, 1709 Forest Hills Dr., Vienna, W. Va. 26105

[21] Appl. No.: 142,956

[22] Filed: Oct. 29, 1993

[51] Int. Cl.[5] ..... A42B 7/00

[52] U.S. Cl. ..... 2/421; 2/425

[58] Field of Search ..... 2/421, 424, 425, 410, 2/411, 417, 9

[56] References Cited

U.S. PATENT DOCUMENTS

| | | | |
|---|---|---|---|
| 3,166,761 | 1/1965 | Strohm . | |
| 3,619,813 | 11/1971 | Marchello . | |
| 4,051,556 | 10/1977 | Davenport et al. | 2/421 |
| 4,062,068 | 12/1977 | Davenport et al. | 2/421 |
| 4,335,472 | 6/1982 | Rappleyea | 2/421 |
| 4,646,368 | 3/1987 | Infusino et al. | 2/421 |
| 4,692,947 | 9/1987 | Black et al. | 2/421 |
| 4,741,054 | 5/1988 | Mattes | 2/421 |

*Primary Examiner*—Clifford D. Crowder
*Assistant Examiner*—Michael A. Neas
*Attorney, Agent, or Firm*—Brady, O'Boyle & Gates

[57] ABSTRACT

An adjustable high/low hook-up chin strap for an athletic helmet, wherein a pair of continuous straps having adjustable fasteners are fixedly connected to a chin cup. One of the straps is provided with a pair of spaced, longitudinally extending slits through which extend end portions of the other strap to provide a cross-over at each end of the chin cup. The slits are dimensioned to allow the other strap to slidably move therein through at least a ±35° arc so that the adjustable fasteners thereon can be connected to the high hook-ups in the helmet regardless of their lower or higher position relative to the lower hook-ups, ups, and each strap can be independently tightened with its respective adjustable fasteners.

15 Claims, 4 Drawing Sheets

ADJUSTABLE HIGH/LOW HOOK-UP CHIN STRAP FOR ATHLETIC HELMETS

BACKGROUND OF THE INVENTION

Four point attachments for connecting a chin strap to an athletic helmet are disclosed in U.S. Pat. No. 3,166,761, dated Jan. 26, 1965; and U.S. Pat. No. 4,646,368, dated Mar. 3, 1987, wherein a first strap is attached to the helmet at a lower part of each of the ear protecting portions of the helmet, and a second strap is attached to the helmet at a higher part of each of the ear protecting portions of the helmet. The first and second straps cross over each other in two places to form a chin cup.

While the position of the lower hook-up for the first strap is substantially standard in most football helmets, the position of the higher hook-up for the second strap varies in different helmets, depending upon the manufacturer of the helmet; thus, the higher hook-up can be positioned in a low position or a high position relative to the lower hook-up, thereby requiring the equipment manager to stock various types of four point attachment chin straps for the various helmets.

In order to provide a four point chin strap attachment which is self-adjusting for accommodating the chin strap to a specific higher hook-up on a helmet, the high/low hook-up chin strap of the present invention has been devised.

SUMMARY OF THE INVENTION

The adjustable high/low hook-up chin strap of the present invention comprises, essentially, a first strap extending along and secured to the upper edge of a chin cup and a second strap extending along and secured to the lower edge of the chin cup. The opposite end portions of each strap extend beyond the opposite ends of the chin cup and are each provided with adjustable snap fasteners adapted to be connected to cooperating snap hook-ups on the ear protection portions of the helmet.

The first strap is provided with a longitudinally extending slit in proximity to each end of the chin cup and the second strap extends through the slit, whereby the first and second straps cross over each other at each end of the chin cup. The length of the slit is dimensioned to be approximately one-and-one-half times the width of the second strap, whereby the second strap is moveable through a 35° arc relative to the first strap, so that the fasteners on each end of the second strap can be easily connected to the higher hook-up on the helmet regardless of their position relative to the lower hook-up, while the fasteners on each end of the first strap are connected to the lower hook-ups, without twisting of the straps. The four fasteners on opposite ends of the two straps provide independent tightening of the two straps since they are slidably and arcuately movably coupled to each other through the slit connections. Independent tightening of the two straps is a feature not available in stitched-together and buckled-together straps.

By this construction and arrangement, the four point chin strap attachment of the present invention can be adapted for use on various helmets, thereby precluding the necessity of maintaining an inventory of various types of four point attachment chin straps.

DESCRIPTION OF THE PREFERRED EMBODIMENT

Figure 1:
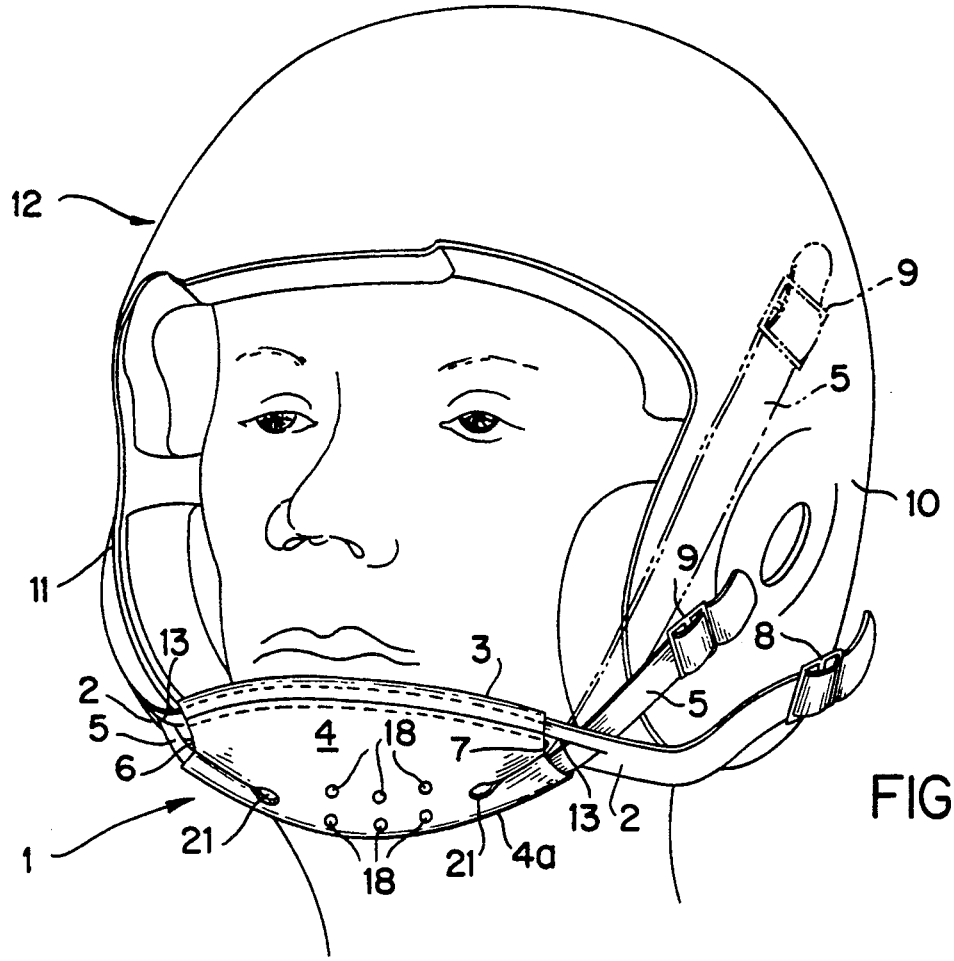
FIG. 1 is a perspective view of the chin strap of the present invention showing the second strap in the lower hook-up position, and, in phantom, in the high hook-up position.
Figure 5:
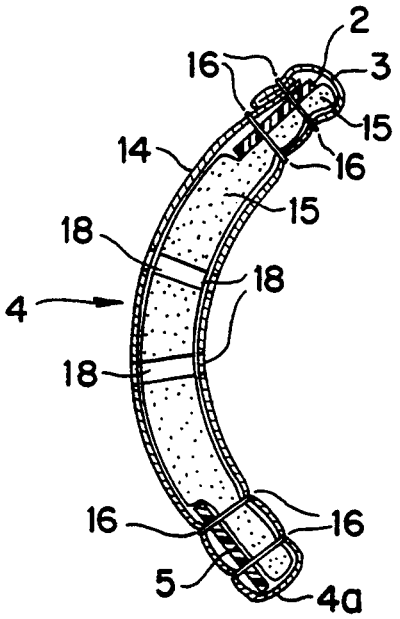
FIG. 5 is a cross-sectional view taken substantially along line 5—5 of FIG. 3.

Referring to the drawings in greater detail, and more particularly to FIG. 1, the adjustable high/low hook up chin strap 1 of the present invention comprises a first strap 2 extending along and secured interior of, and to the upper edge 3 of a chin cup 4, and a second strap 5 extending along and secured interior of, and to the lower edge 4*a* of the chin cup 4.

The opposite end portions of each strap 2 and 5 extend beyond the opposite ends 6 and 7 of the chin cup 4 and are each provided with adjustable snap type fasteners 8 and 9 adapted to be connected to cooperating low and high snap type hook-ups, respectively, provided on the ear protection portions 10 and 11 of the helmet 12. The first strap 2 is provided with a longitudinally extending slit 13 in proximity to each end 6 and 7 of the chin cup 4, and the second strap 5 extends through the slit 13, whereby the first and second straps 2 and 5 cross over each other at each end 6 and 7 of the chin cup 4. By this construction and arrangement, the fastener 9 on the second strap 5 can be connected to the higher hook-up on the helmet in either the position shown in solid lines, or in phantom.

The details of the construction of the straps 2 and 5, and associated chin cup 4 are illustrated in FIGS. 2, 3, 5 and 6, wherein it will be seen that the chin cup 4 comprises an envelope 14 of soft durable fabric containing a low density foam pad 15. The straps 2 and 5 are a webbing reinforced plastic strip with the strap 2 extending through the interior of envelope 14 in proximity to the upper edge 3, and the strap 5 extending through the interior of envelope 14 in proximity to the lower edge 4*a*. The continuous straps 2 and 5 are fixedly secured to the envelope 14 by double row, longitudinally extending stitching 16, and transversely extending stitching 17. The transversely extending stitching 17 reinforces the inner ends of slits 13, and the outer ends of slits 13 are reinforced by cross-stitching 23 through strap 2. A plurality of ventilation holes 18 are provided in the central portion of the envelope 14 and extend through the outer layer of the envelope 14 and the pad 15. Each end of the envelope 14 is formed with a bifurcated configuration having outwardly extending divergent edge portions 19 and 20, the convergent ends of the edge portions 19 and 20 terminating in a circular opening 21.

Figure 6:
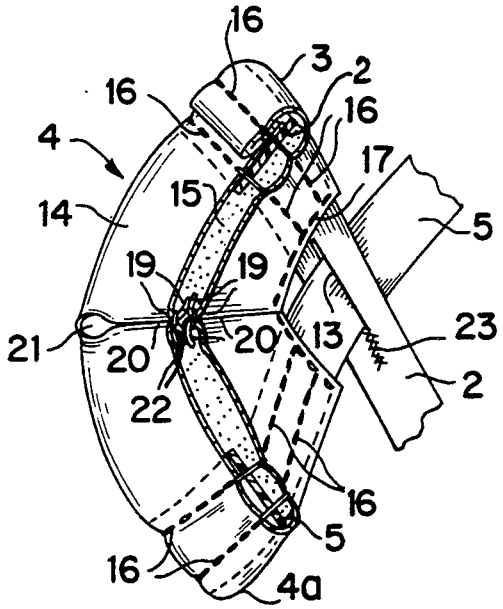
FIG. 6 is a view, partly in cross-section, taken substantially along line 6—6 of FIG. 3.
Figure 2:
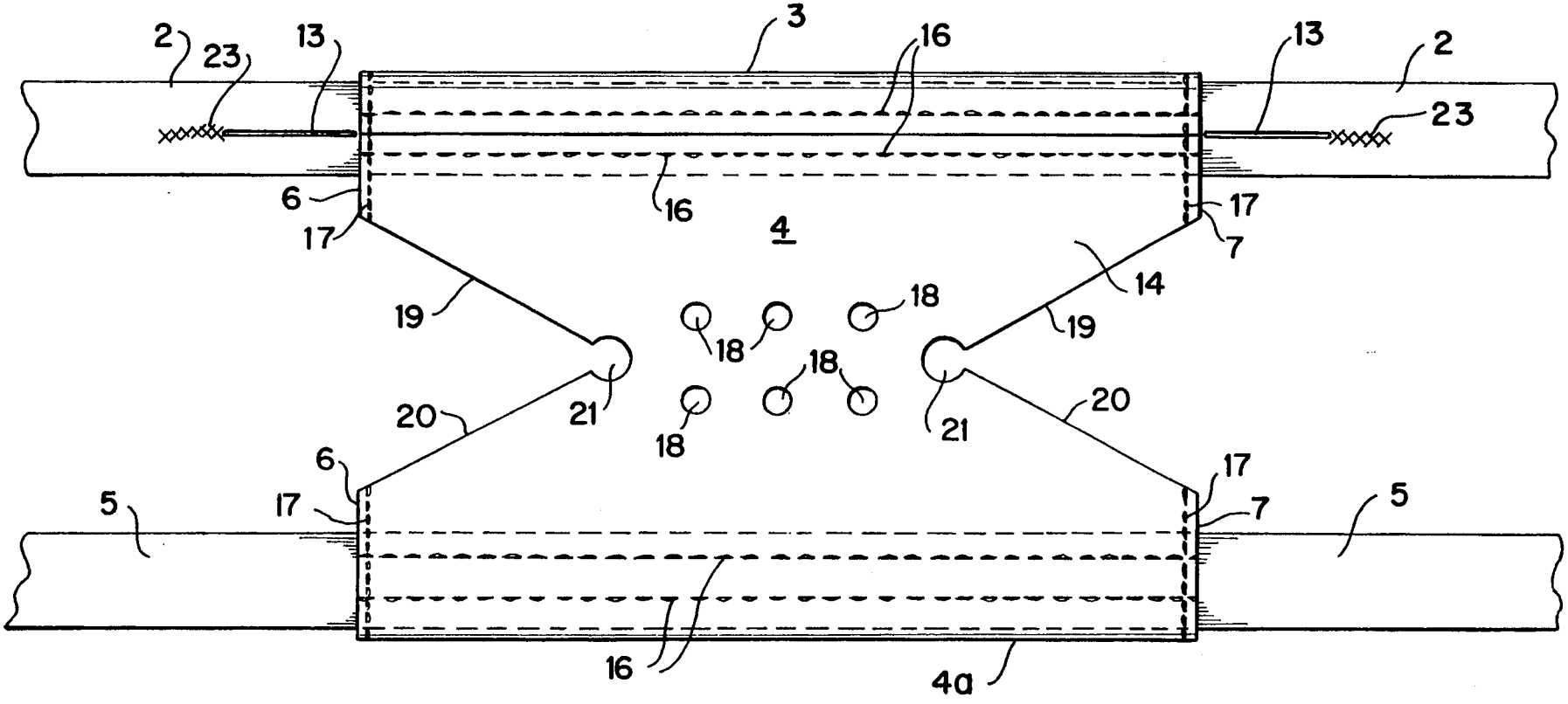
FIG. 2 is a top plan view of the chin cup portion having the first and second straps extending along and secured to the upper and lower edges of the chin cup portion before the chin cup portion is completely assembled and stitched.
Figure 3:
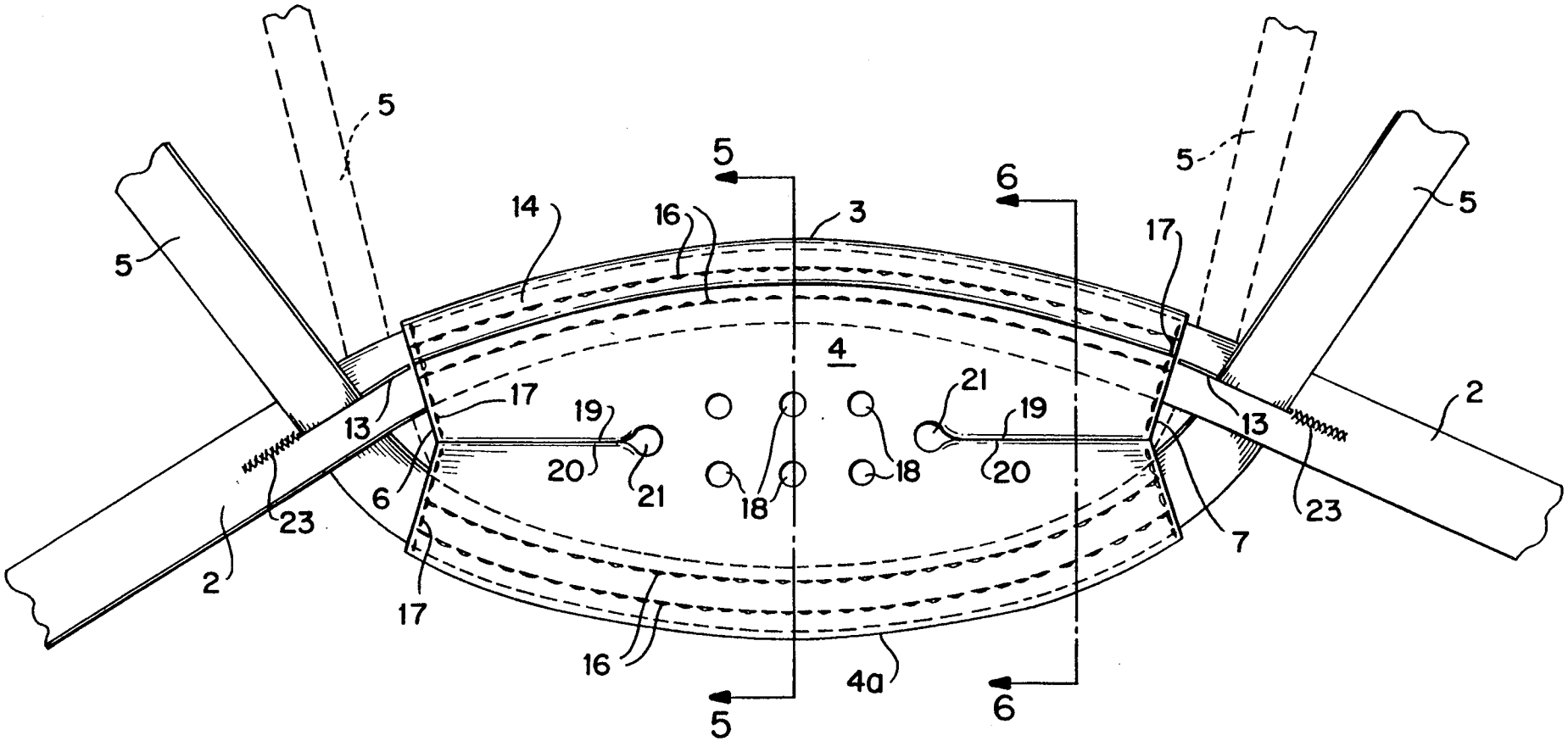
FIG. 3 is a front elevational view of the outside of the chin cup and associated straps crossover at two places at each end of the chin cup, wherein the second strap extends through a slit provided in the first strap.

To form the envelope 14 into the chin cup 4 the opposite ends of the envelope are folded so that the edge portions 19 and 20 thereof become in abutting overlying relationship and are secured together by stitching 22, as shown in FIG. 6. The strap 5 is then inserted through the slits 13, as shown in FIG. 3. The circular openings 21 also provide ventilation holes, as shown, similar to holes 18.

Figure 4:
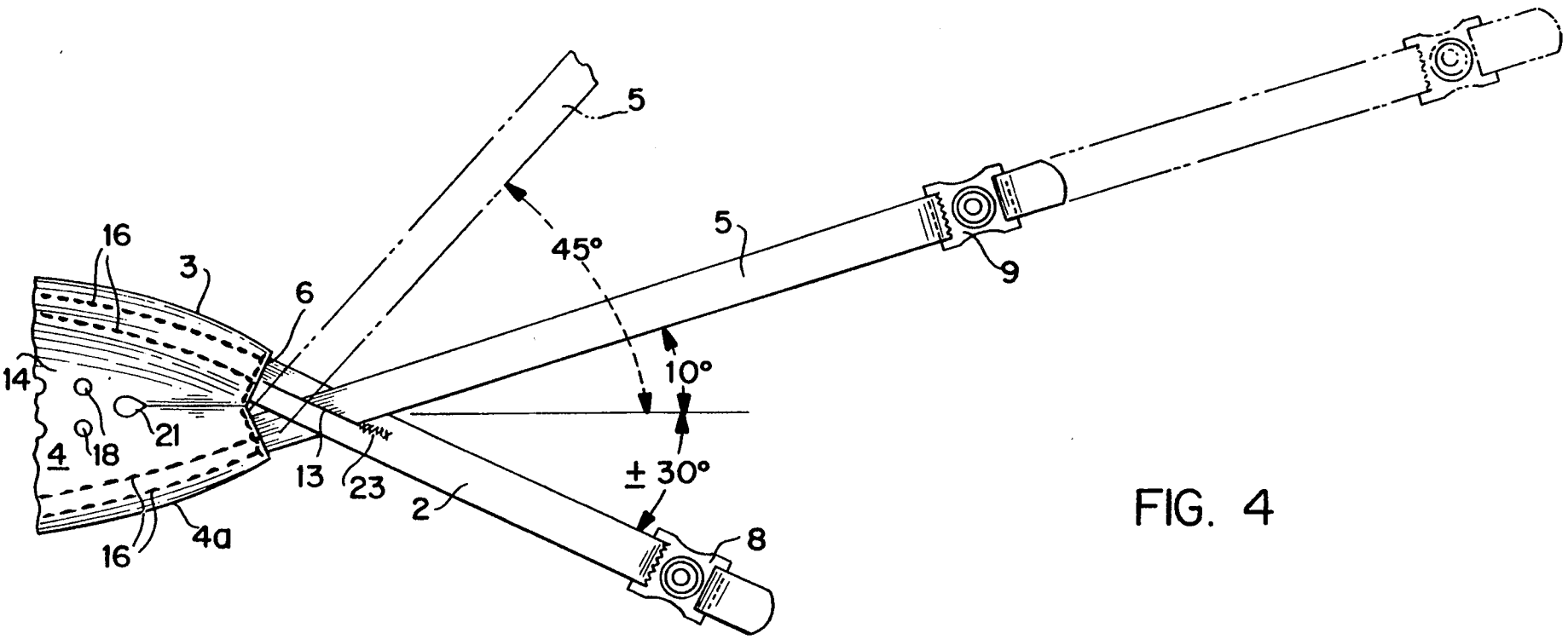
FIG. 4 is a fragmentary plan view of the inside of the chin cup and associated straps, the view being taken from FIG. 3 turned end to end 180°, wherein the various angular adjustments of the second strap relative to the first strap is illustrated.

As will be seen in FIG. 4, the slit 13 is at least one and one-half times the width of strap 5, whereby the strap 5 can be adjusted back and forth in the slit through an arc of ±35° from the lower to the higher hook-up on the helmet 12, as shown in FIG. 1, when the helmet is provided with a higher hook-up in a higher position as shown in phantom, or in a lower position shown in solid lines. The included angles between straps 2 and 5 are thus adjustable in the range of ±40° to ±75°.

The strap 5 is longer than strap 2 and is provided with a length to enable the snap fasteners 9 thereon to mate with cooperating snap fasteners on a helmet in the higher position, as shown in phantom lines in FIGS. 1 and 4. If a particular helmet has a lower position hook-up for the higher hook-up strap 5, as shown in full lines in FIG. 1, then snap fasteners 9 are adjusted inwardly on straps 5 to the correct position, and then the extra unneeded length of the ends of the strap shown in phantom in FIG. 4 are cut-off.

From the above description it will be readily appreciated by those skilled in the art that the four point chin strap attachment of the present invention can be adapted for use on various helmets, thereby precluding the necessity of maintaining an inventory of various types of four point attachment chin straps. Furthermore, by fixedly securing the straps 2 and 5 along the opposite longitudinal edges 3 and 4*a* of the chin cup 4, with strap 5 at each end slidably passing through the slits 13 in strap 2, the moveable cross-over retention of the straps 2 and 5 is made self-adjusting for independent action and tightening of the two straps, so the only adjustment for the straps 2 and 5 is at the four slidable snap fasteners 8 and 9. It will be noted that the slits 13 may be in strap 5 rather than in strap 2, as shown, but experimentation has shown that providing the slits in the strap 2 that crosses the top of the chin, in general, better accommodates a variety of included angles for high/low hook-ups on helmets from various manufacturers. The advantage of independent tightening of strap 2 by slidable snap fasteners 8, and strap 5 by slidable snap fasteners 9, is firm fixation of the helmet against rotation on the user's head relative to the chin of the user during front and rear impacts of the helmet.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

We claim:

1. An adjustable high/low hook-up chin strap for a helmet having high and low hook-ups on ear protector portions of the helmet, comprising a chin cup having an upper edge, a lower edge and opposite end portions, a first strap extending along and secured to the upper edge of said chin cup, a second strap extending along and secured to the lower edge of said chin cup, the opposite end portions of each strap extending beyond the opposite end portions of the chin cup, a pair of spaced, longitudinally extending slits provided in said first strap, each slit being positioned in proximity to a respective end portion of said chin cup, the opposite end portions of the second strap extending through a respective slit, whereby the first and second straps cross over each other at each end portion of the chin cup, adjustable fasteners connected to the opposite end portions of each strap; the adjustable fasteners on said first strap being adapted to be connected to the low hook-ups on the helmet, the adjustable fasteners on said second strap being adapted to be connected to the high hook-ups on the helmet, the length of each slit being dimensioned to allow the second strap to be moveable therein, whereby the adjustable fasteners on each end of the second strap can be connected to the higher hook-up on the helmet regardless of their position relative to the lower hook-ups.

2. The chin strap according to claim 1, wherein the chin cup comprises an envelope of soft durable fabric having opposite side edges and end edges, a low density foam pad contained within said envelope, the first and second straps extending through said envelope, and stitching extending through said straps and said envelope for fixedly securing said straps to the opposite side edges of the envelope.

3. The chin strap according to claim 2, wherein each strap comprises a webbing reinforced plastic strip.

4. The chin strap according to claim 2, wherein a plurality of ventilation holes extend through the envelope and the pad.

5. The chin strap according to claim 2, wherein each end edge of the envelope is formed with a bifurcated configuration having outwardly extending divergent edge portions, each opposite end of the envelope being folded so that the divergent edge portions are in butting relationship, and stitching extending through said edge portions for holding the edge portions in abutting relationship.

6. The chin strap according to claim 1, wherein the length of each slit is approximately one-and-one-half times the width of the second strap, whereby the second strap is moveable through at least a ±35° arc.

7. The chin strap according to claim 1, wherein the length of each slit is greater than the width of the second strap, whereby the second strap is angularly adjustably moveable through an arc relative to said first strap.

8. The chin strap according to claim 1, in which each slit having an end spaced remote from the respective end portion of said chin cup, and reinforcement means on said first strap at said remote spaced end of each slit.

9. The chin strap according to claim 2, and second stitching extending transverse through said straps and through the end edges of the envelope, whereby the ends of said slits in proximity to the end portion of said chin cup are reinforced.

10. The chin strap according to claim 1, including an included angle between said first and second straps at each end portion of the chin cup, and said slits are of a length that said first and second straps are angularly adjustable relative to each other to provide said included angle in the range of ±40°–±75°.

11. An adjustable high/low hook-up chin strap for a helmet having high and low hook-ups on ear protector portions of the helmet, comprising a chin cup having an upper edge, a lower edge and opposite end portions, a first strap extending along and secured to the upper edge of said chin cup, a second strap extending along and secured to the lower edge of said chin cup, the opposite end portions of each strap extending beyond the opposite end portions of the chin cup, a pair of spaced, longitudinally extending slits provided in one of said first and second straps, each slit being positioned in proximity to a respective end portion of said chin cup, the opposite end portions of the other of said second and first straps extending through a respective slit, whereby the first and second straps cross over each other at each end portion of the chin cup, adjustable fasteners connected to the opposite end portions of each strap; the adjustable fasteners on said first strap being adapted to be connected to the low hook-ups on the helmet, the adjustable fasteners on said second strap being adapted to be connected to the high hook-ups on the helmet, the length of each slit being dimensioned to allow the second strap to be moveable relative to the first strap via the slit crossover connection of the straps, whereby the adjustable fasteners on each end of the second strap can be connected to the higher hook-up on the helmet regardless of their position relative to the lower hook-ups.

12. The chin strap according to claim 11, wherein the chin cup comprises an envelope of soft durable fabric having opposite side edges and end edges, a low density foam pad contained within said envelope, the first and second straps extending through said envelope, and stitching extending through said straps and said envelope for fixedly securing said straps to the opposite side edges of the envelope.

13. The chin strap according to claim 11, including an included angle between said first and second straps at each end portion of the chin cup, and said slits are of a length that said first and second straps are angularly adjustable relative to each other to provide said included angle in the range of $\pm 40°-\pm 75°$.

14. The chin strap according to claim 11, wherein the length of each slit is greater than the width of said other of said second and first straps extending therethrough, whereby said second and first straps are angularly adjustably moveable through an arc relative to each other.

15. The chin strap according to claim 11, wherein the length of each slit is greater than the width of said other of said second and first straps extending therethrough, whereby said second and first straps can be independently tightened with said respective adjustable fasteners.

* * * * *